United States Patent [19]

Hunter et al.

[11] 4,305,561

[45] Dec. 15, 1981

[54] CLAMP

[75] Inventors: Rodney J. A. Hunter, Etwall; Henry Mappin, Wigan, both of England

[73] Assignee: Coal Industry (Patents) Limited, London, England

[21] Appl. No.: 948,862

[22] Filed: Oct. 5, 1978

[30] Foreign Application Priority Data

Oct. 7, 1977 [GB] United Kingdom ..... 41786/77

[51] Int. Cl.[3] ..... A47B 96/06

[52] U.S. Cl. ..... 248/228; 248/225.4

[58] Field of Search ..... 248/228, 225.4, 226.1, 248/226.3, 316 C, 316 E; 24/263 A, 263 SB

[56] References Cited

U.S. PATENT DOCUMENTS

| | | | |
|---|---|---|---|
| 227,686 | 5/1880 | Goodrich | 24/263 A |
| 1,303,424 | 5/1919 | Wahlberg | 248/228 X |
| 1,402,399 | 1/1922 | Crabill | 248/228 |
| 1,592,814 | 7/1926 | Harris | 248/228 UX |
| 1,768,543 | 7/1930 | Clausing | 248/228 |
| 3,321,172 | 5/1967 | Buss | 24/263 SB X |

FOREIGN PATENT DOCUMENTS

| | | | |
|---|---|---|---|
| 2821747 | 11/1979 | Fed. Rep. of Germany | 248/228 |
| 167841 | 3/1934 | Switzerland | 24/263 A |
| 1250607 | 10/1971 | United Kingdom . | |

*Primary Examiner*—J. Franklin Foss

*Attorney, Agent, or Firm*—Stevens, Davis, Miller & Mosher

[57] ABSTRACT

A clamp comprises two opposed generally 'C' shaped components each of which co-operates with a wedge formation on the other of the components in a manner which upon the drawing together of the two components the wedge formation effectively reduces the space between the limbs of the generally 'C' shaped formation of the other component.

6 Claims, 4 Drawing Figures

CLAMP

The present invention relates to clamps suspendable from 'I' section beams.

In particular, although not exclusively, the present invention relates to a clamp suspendable from an 'I' section beam supporting a working in an underground mine, the clamp providing an anchorage mounting capable of withstanding considerable loading.

An object of the present invention is to provide a clamp which is suspendable from an 'I' section mine roof supporting beam in an underground working to provide an anchorage mounting capable of withstanding considerable loading and which is rapidly releasable or unclampable from one 'I' section beam for rapid resetting or reclamping on another 'I' section beam as the mine working advances.

According to the present invention there is provided a two component clamp, one component of which has a generally 'C' shaped formation which co-operates with a wedge formation on the other component in a manner which upon the drawing together of the two components the wedge formation of said other component effectively reduces the space between the limbs of the generally 'C' shaped formation of said one component.

Preferably, each component of the clamp has a generally 'C' shaped formation and a wedge formation.

The present invention also provides a clamp suspendable from a horizontally extending flange of an 'I' section beam, the clamp comprising two co-operating components defining opposed generally 'C' shaped formations mountable on opposite sides of the flange, respectively, and rapidly releasable means for retaining the two components in a flange clamping mode such that, in use, when the clamp is suspended from the horizontally extending flange each side of the flange lies between a relatively upper margin of the generally 'C' shaped formation defined by one of the components and an intermediate margin of the generally 'C' shaped formation defined by the other of the components, each side of the flange together with the adjacent intermediate margin of the generally 'C' shaped formation defined by the said other of the components being wedged between the relatively upper margin and a relatively lower margin of the generally 'C' shaped formation defined by said one component.

Advantageously, the rapidly releasable means is adapted to resiliently bias the two components towards the flange clamping mode.

Preferably, the upper and intermediate margins present curved contacting faces in a direction transverse to the longitudinal axis of the beam.

By way of example only, one embodiment of the present invention will be described with reference to the accompanying drawings, in which.

Figure 1:
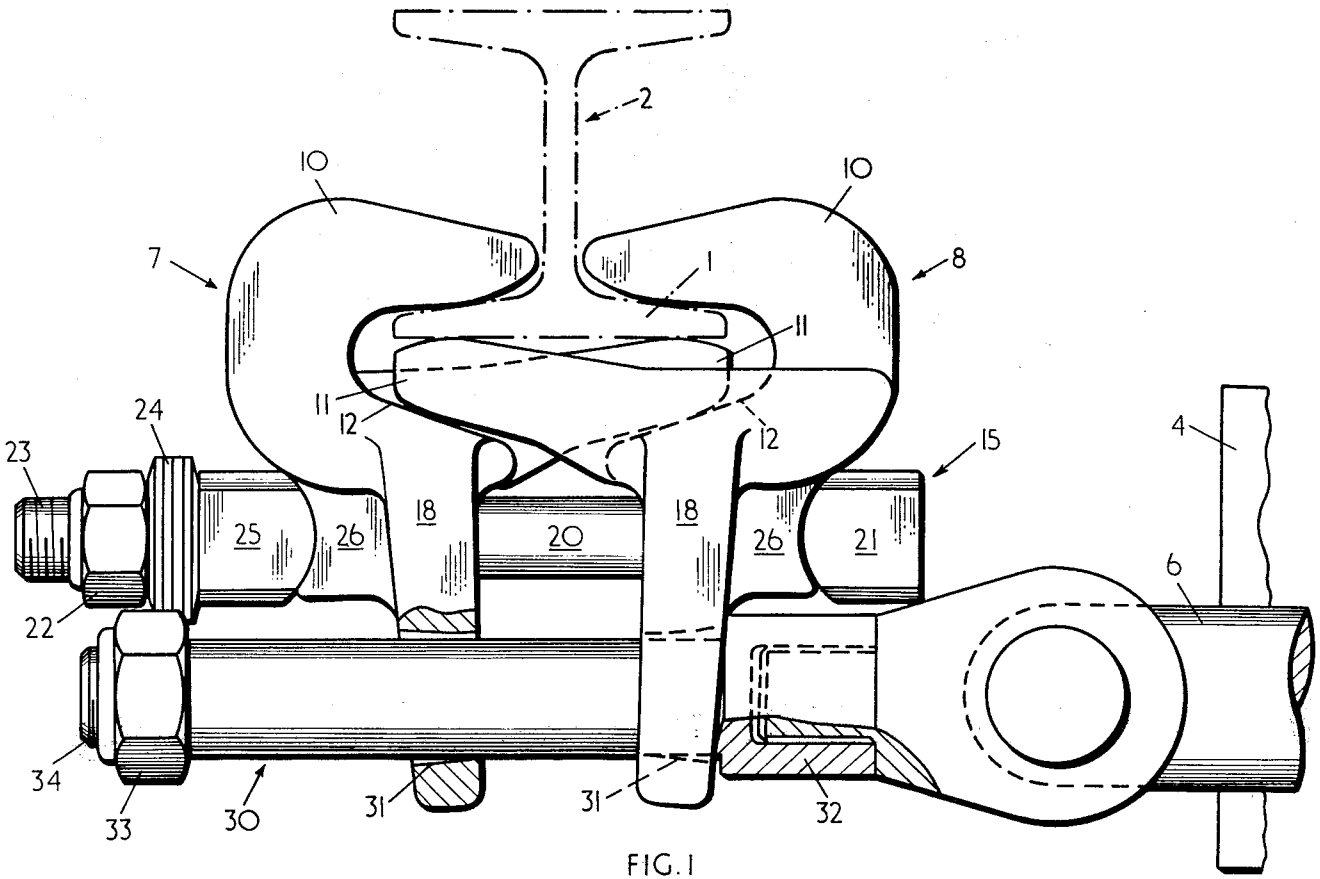
FIG. 1 shows a view partly in section of a clamp suspended from a horizontally extending flange of an 'I' section mine roof supporting beam, the clamp being shown in a direction looking along the longitudinal axis of the beam and being provided with a shackle for attachment to an advancing ram of a mining machine only a portion of which is shown.

In FIG. 1 a clamp constructed in accordance with the present invention is shown suspended from a horizontally extending flange 1 of an 'I' section mine roof support beam 2 installed along a tunnel or roadway in an underground mine, the tunnel or roadway being extended by a mining machine 4 (only a rear portion of which is shown in FIG. 1) which is carried along a suspended track (not shown in FIG. 1 but shown later in FIGS. 1 and 3) and which is advanced by means of an advancing ram 6 secured between the mining machine 4 and the clamp which provides an anchorage mounting for the advancing ram capable of withstanding considerable loading generated when the machine is advanced and when it is cutting rock to extend the tunnel or roadway.

The clamp comprises two co-operating components 7 and 8 which (as viewed in FIG. 1) define opposed, generally 'C' shaped formations, respectively, and which are engaged on opposite sides of the horizontally extending flange 1 of the beam 2, each side of the flange 1 lies between an upper margin 10 of the 'C' shaped formation defined by one of the components 7 or 8 and an intermediate margin 11 of the 'C' shaped formation defined by the other of the components 8 or 7. Also, each side of the flange 1 together with the adjacent intermediate margin 11 of the 'C' shaped formation defined by said other of the components 8 or 7 is wedged between the upper margin 10 and a lower margin 12 of the 'C' shaped formation defined by said one component 7 or 8.

Thus, when in the position as shown in FIG. 1 the clamp is fixedly clamped to the beam 2 and is capable of withstanding the considerable loading associated with the mining machine being advanced or with the machine when cutting.

The working or contacting surfaces of components 7 and 8 associated with the upper and intermediate margins are curved (as seen in FIG. 1) in order to try and ensure that when the clamp is used with different sizes of 'I' section beam the components tend to contact the flange at points remote from the web of the beam and remote from the extreme tips of the flange.

The upper and lower margins 10 and 12 of the component 7 are provided by a pair of spaced generally 'C' shaped outer formations while the intermediate margin 11 is provided by a central projection arranged intermediate the two outer formations. The upper and lower margins 10 and 12 of the component 8 are provided by a generally 'C' shaped central formation while the intermediate margin 11 is provided by a pair of spaced projections. Thus, when the clamp is suspended from the flange the central projection providing the intermediate margin 11 of component 7 engages directly between the single 'C' shaped central formation providing the upper and lower margins 10 and 12 of component 8. Also the two projections providing the intermediate margin 11 of the component 8 engage directly between the spaced generally 'C' shaped outer formations providing the upper and lower margins 10 and 12 of the component 7. Thus, the two components 7 and 8 are intermeshed in the direction of the longitudinal axis of the beam. (The formations and projections can be seen more clearly in FIGS. 2 and 3).

The components 7 and 8 are retained in the clamping mode by rapidly releasable means 15 located within aligned slots (not shown in FIG. 1) provided in projections 18 constituting parts of the components 7 and 8. The rapidly releasable means 15 comprises a bolt 20 having a fixed, shaped head 21, a nut 22 engageable along a thread 23 of the bolt, a resilient washer 24 and a shaped washer 25. The shaped head and washer have convex surfaces which when the means 15 are retaining the components 7 and 8 in the clamping mode engage with concave surfaces provided by spacer members 26 on the components 7 and 8. The resilient washer 24 is provided to ensure that the means 15 urges the components 7 and 8 towards the clamping mode. Operation of the rapid releasable means 15 is described later in the specification with reference to FIGS. 2, 3 and 4.

The clamp is provided with a shackle 30 attached to the advancing ram 6 of the mining machine 4 and engaged in bores 31 provided in the projections 18 of the components 7 and 8. The shackle 30 is slidable along the bores 31 between abutments constituted by the shackle head 32 and a nut 33 screwed onto a thread 34 provided on the shackle. The limited sliding movement is provided in order that when the rapidly releasable means 15 are actuated to allow the components 7 and 8 of the clamp to be released or unclamped from the flange 1, the two components freely may be slid off the flange without any obstruction from the shackle.

As mentioned earlier some details of the clamp and operation of the rapid releasable means 15 are described in more detail with reference to FIGS. 2, 3 and 4 which show the same construction of clamp as that shown in FIG. 1 but the clamp is performing an alternative function.

Figure 2:
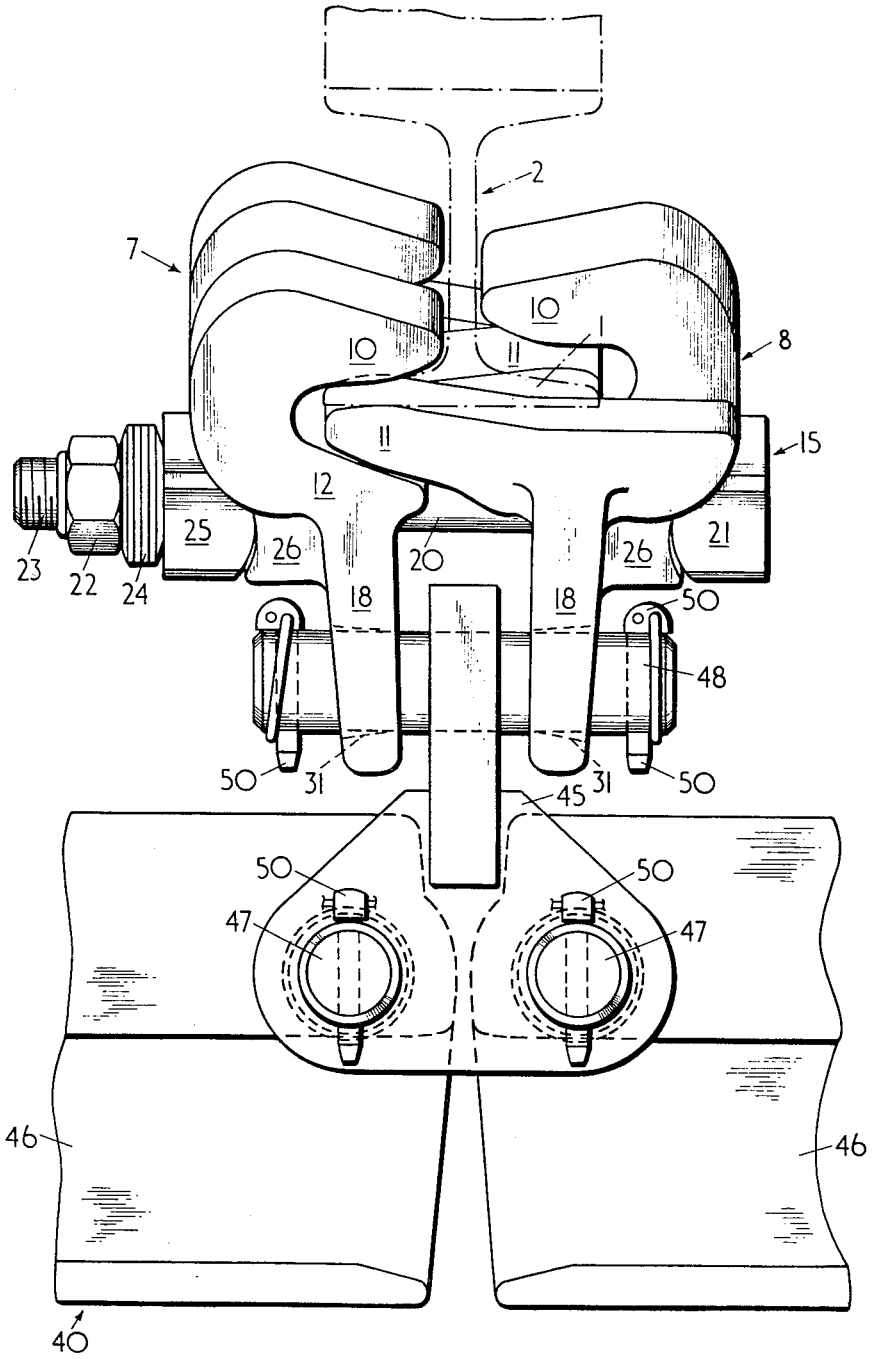
FIG. 2 shows a view of a clamp suspended from a horizontally extending flange of an 'I' section mine roof supporting beam, the clamp being shown looking in a horizontal direction and being provided with a pin supporting two adjacent rails of an overhead track.
Figure 3:
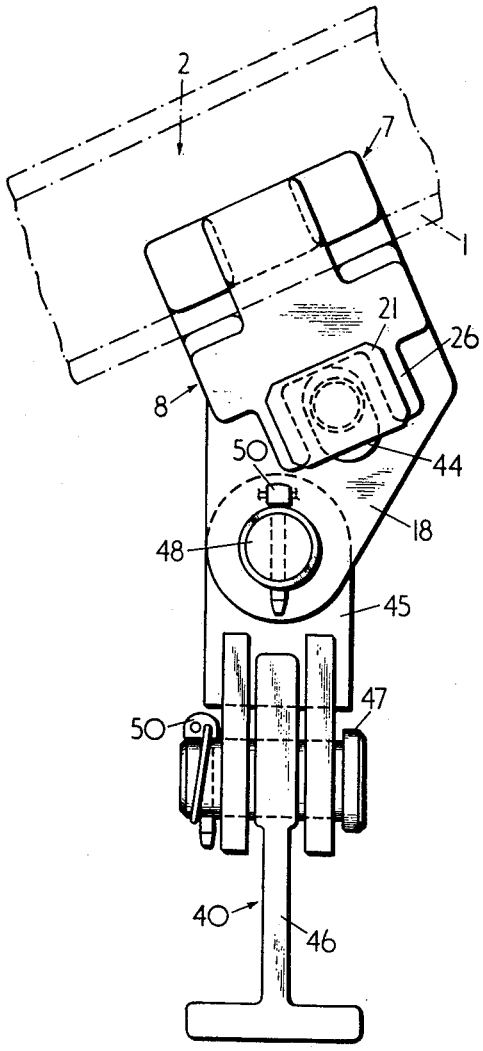
FIG. 3 is a view of FIG. 2 looking in a direction normal to the longitudinal axis of the beam.
Figure 4:
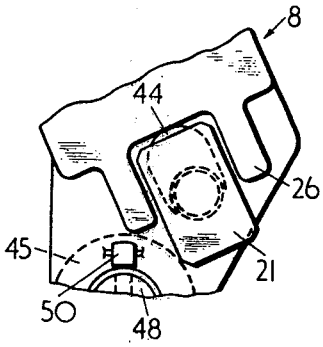
FIG. 4 is a scrap view of a detail of FIG. 3 shown in an alternative operational position to that in FIG. 3.

In FIGS. 2, 3 and 4 the clamp is shown carrying a track assembly 40 comprising two parallel tracks (only one of which is shown) for supporting the mining machine mentioned previously with reference to FIG. 1. As the construction of the clamp in FIGS. 2, 3 and 4 is identical to that shown in FIG. 1 the same reference numbers have been used for the same items. The description of the clamp included previously with reference to FIG. 1 is not repeated.

The track assembly 40 comprises rails 46 secured by pins 47 to a link member 45 carried on a support pin 48 engaged within bores 31 which in FIG. 1 were engaged by the shackle 30. Pins 47 and 48 are retained in position by quickly removed resiliently biased linch clips or pins 50.

The generally 'C' shaped formations and the projections of the components 7 and 8 providing the upper, intermediate and lower margins 10, 11 and 12 are shown more clearly in FIGS. 2 and 3.

Operation of the rapidly releasable means 15 is illustrated more clearly in FIGS. 2, 3 and 4. In FIGS. 2 and 3 the bolt head 21 is shown in a position engaging the concave surfaces of the spacer members 26 with the nut 22 abutting the resilient washer 24 to retain the components 7 and 8 in the clamping mode. In FIG. 3 the shank of the bolt 20 clearly can be seen in the slot 44 which was previously mentioned with reference to FIG. 1 but which is not shown in FIG. 1. Also, the bolt head 21 can be seen to have a rectangular cross-section and is shown bridging across the adjacent spacer member 26 which is constituted by two parallel lugs. Although not shown the washer 25 is of similar rectangular cross-section to the bolt head and engages the spacer member 26 on component 7 in a similar manner to that shown in FIG. 3.

When it is desired to advance the track assembly 40 as the tunnel or roadway is advanced, rails 46 are disconnected from the link member 45 by removing pins 47. Pin 48 is removed from bores 31 to free the link member and thereby the clamp from the track assembly. Pins 47 and 48 are provided with quickly removed linch clips or pins 50 to allow rapid operation. A similar dismantling procedure is carried out for the rails forming the parallel track (not shown) of the track assembly 40.

To release or unclamp the clamp from the flange 1, the nut 22 is unscrewed by a relatively small amount just sufficient to allow the convex surface of the washer 25 to clear the concave surface of the adjacent spacer member 26. This allows the washer 25 to be rotated until it can be accommodated within the two parallel lugs of the spacer member 26. The bolt head 21 is then rotated to the position indicated in FIG. 4 when it too can be accommodated within the two parallel lugs of the spacer member 26. There is then sufficient clearance along the bolt 20 for the two components 7 and 8 to be slid off the flange 1 to release the clamp from the beam 2. The clamp is then advanced and reset or clamped to another beam installed further along the tunnel or roadway. The clamp is reset rapidly on the next beam by engaging the components 7 and 8 on the horizontally extending flange, remounting the bolt head and washer with their convex surface lying adjacent to the concave surfaces of the spacer members and tightening the nut onto the bolt. From the above description it will be appreciated that by turning the screw through two or three rotations it is rapidly possible to gain sufficient free longitudinal movement of the bolt within the slots 44 to allow the components 7 and 8 to be slid free of the flange. In addition, the clamp construction is capable of withstanding considerable loading arising due to supporting the heavy mining machine during its advance along the track assembly and due to reaction forces when the machine is excavating rock to extend the tunnel or roadway.

We claim:

1. A two component clamp, each component having first and second limbs defining a generally 'C' shaped formation with a mouth therebetween facing toward the other component, a limb of one component having a surface which cooperates with a wedge formation on the other component in a manner so that, upon the drawing together of the two components, the wedge formation is inserted into the mouth of the other component to effectively at least partially close the mouth and reduce the space between the limbs of that generally 'C' shaped formation.

2. The clamp of claim 1, in which one component has two upper limbs and one lower limb and the other component has one upper limb and two lower limbs, said limbs being spaced to interdigitate when the components are drawn together.

3. A clamp suspendable from a horizontally extending flange of an 'I' section beam, comprising two cooperating components, each having upper and lower limbs defining opposed generally 'C' shaped formations mountable on opposite sides of the flange, respectively, and rapidly releasable means for retaining the two components in a flange clamping mode such that, in use, when the clamp is suspended from the horizontally extending flange, each side of the flange lies within one of the generally 'C' shaped formations with each side of the flange together with the adjacent intermediate margin of its generally 'C' shaped formation being shaped to extend into the opposed generally 'C' shaped formation, that extension being wedged between the relatively upper margin of the lower limb and a portion of said beam when suspended from said beam.

4. The clamp of claim 3 in which one component has two upper limbs and one lower limb and the other component has one upper limb and two lower limbs, said limbs being spaced to interdigitate when the components are drawn together.

5. A clamp as claimed in claim 3, in which the rapidly releasable means is adapted to resiliently bias the two components towards the flange clamping mode.

6. A clamp as claimed in claims 3 or 5, in which the upper and intermediate margins present curved contacting faces in a direction transverse to the longitudinal axis of the beam.

* * * * *